US005487436A

United States Patent [19]

Griffin

[11] Patent Number: 5,487,436

[45] Date of Patent: Jan. 30, 1996

[54] CUTTER ASSEMBLIES FOR ROTARY DRILL BITS

[75] Inventor: Nigel D. Griffin, Whitminster, England

[73] Assignee: Camco Drilling Group Limited, Stonehouse, England

[21] Appl. No.: 183,048

[22] Filed: Jan. 18, 1994

[30] Foreign Application Priority Data

Jan. 21, 1993 [GB] United Kingdom ..... 9301146

[51] Int. Cl.[6] ..... E21B 10/46

[52] U.S. Cl. ..... 175/432; 175/433

[58] Field of Search ..... 175/433, 434, 175/432, 431, 428; 51/293

[56] References Cited

U.S. PATENT DOCUMENTS

| | | | |
|---|---|---|---|
| 4,505,721 | 3/1985 | Almond et al. | 51/293 X |
| 4,604,106 | 8/1986 | Hall et al. | 51/293 |
| 4,608,226 | 8/1986 | Lauvinerie et al. | 175/430 X |
| 4,669,522 | 6/1987 | Griffin | 164/97 |
| 4,694,918 | 9/1987 | Hall | 175/329 |
| 4,705,124 | 11/1987 | Abrahamson et al. | 175/410 |
| 4,780,274 | 10/1988 | Barr | 175/433 X |
| 4,784,023 | 11/1988 | Dennis | 76/108 A |
| 4,798,026 | 1/1989 | Cerceau | 51/307 X |
| 4,811,801 | 3/1989 | Salesky et al. | 175/329 |
| 4,919,220 | 4/1990 | Fuller et al. | 175/433 |
| 5,000,273 | 3/1991 | Horton et al. | 175/329 |
| 5,007,207 | 4/1991 | Phaal | 51/204 |
| 5,011,515 | 4/1991 | Frushour | 51/307 |
| 5,120,327 | 6/1992 | Dennis | 51/293 |
| 5,217,081 | 6/1993 | Waldenstrom et al. | 175/420.2 |

FOREIGN PATENT DOCUMENTS

| | | | |
|---|---|---|---|
| 0145421 | 6/1985 | European Pat. Off. . | |
| 0193361 | 9/1986 | European Pat. Off. . | |
| 0219959 | 4/1987 | European Pat. Off. . | |
| 0291314 | 11/1988 | European Pat. Off. . | |
| 462091 | 12/1991 | European Pat. Off. | 175/434 |

*Primary Examiner*—Hoang C. Dang

[57] ABSTRACT

A method of forming a cutter assembly for a rotary drill bit comprises locating in a mould a preform polycrystalline diamond cutting element of a non-thermally stable type, packing powdered matrix-forming material, such as powdered tungsten carbide, around at least part of the cutting element within the mould, and then infiltrating the powdered material with a metal alloy in a furnace to form a body of solid infiltrated matrix in which the cutting element is at least partly embedded. The metal alloy is selected to provide an infiltration temperature, for example of up to about 850°, which is not greater than the temperature at which significant thermal degradation of the cutting element would occur.

11 Claims, 3 Drawing Sheets

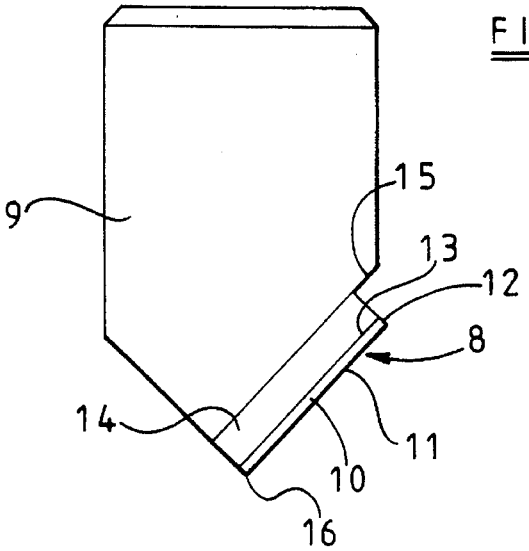
FIG 3
FIG 4
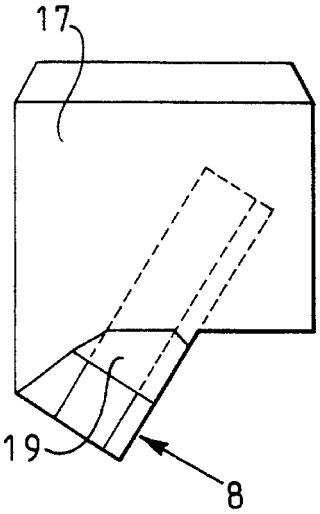
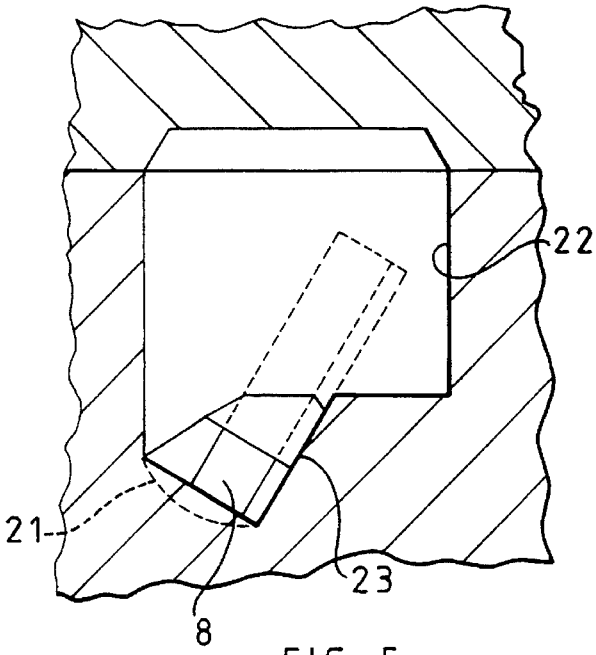
FIG 5

CUTTER ASSEMBLIES FOR ROTARY DRILL BITS

BACKGROUND OF THE INVENTION

The invention relates to cutter assemblies for rotary drag-type drill bits, for use in drilling or coring holes in sub-surface formations, and of the kind comprising a bit body having a shank for connection to a drill string, a plurality of cutter assemblies mounted at the surface of the bit body, and a passage in the bit body for supplying drilling fluid to the surface of the bit body for cooling and/or cleaning the cutter assemblies.

In drag-type drill bits of this kind the bit body may be machined from metal, usually steel, sockets to receive the cutter assemblies being drilled into the bit body. Alternatively, the bit body may be formed by a powder metallurgy process. In this process a hollow mould is formed, for example from graphite, in the configuration of the bit body or a part thereof. The mould is packed with powdered matrix-forming material, such as powdered tungsten carbide, which is then infiltrated with a metal alloy, such as a copper alloy, in a furnace so as to form a hard matrix. Using conventional infiltration alloys, the furnace temperature required to form the matrix is usually of the order of 1000° C. to 1170° C.

The present invention relates to the manufacture of cutter assemblies of the kind in which a preform polycrystalline diamond cutting element is mounted on a carrier of material which is less hard than the diamond, the carrier then in turn being secured within a socket in the bit body.

A common form of cutting element comprises a flat tablet, usually circular, having a front cutting table of polycrystalline diamond bonded to a substrate of less hard material, such as cemented tungsten carbide. The layer of polycrystalline diamond is formed and bonded to the substrate in a high pressure, high temperature press, and one or more transition layers may sometimes be provided between the cutting table and substrate. The general details of manufacture of such cutting elements are well known and do not form a part of the present invention.

The carrier is usually in the form of a cylindrical post or stud and may, for example, also be formed from cemented tungsten carbide. Each cutting element is normally mounted on its carrier by brazing the rear surface of the substrate to a surface of the carrier. However, two-layer and multi-layer cutting elements of the kind described tend to degrade when subjected to very high temperatures, and in this case they are therefore often referred to as being non-thermally stable. As the temperature to which the cutting elements are subjected increases, differential expansion between the layers of the element may cause delamination or separation of the diamond layer from the substrate. Very high temperatures may also lead to degradation of the polycrystalline diamond material itself. In view of this, special brazing processes have to be used when brazing such a non-thermally stable cutting element to its carrier, to ensure that unacceptable degradation of the cutting element does not occur. One such brazing process is known as "LS bonding".

There also exist polycrystalline diamond cutting elements which are referred to as thermally stable. These normally consist of only a single body of polycrystalline diamond of a particular type, not bonded to a substrate.

Currently, conventional two-layer or multi-layer cutting elements are usually regarded as not being thermally stable above a temperature of about 750° C. However, it will be appreciated that, for any given cutting element, there is not an exact critical temperature at which thermal degradation suddenly occurs, and it is possible that some "non-thermally stable" cutting elements might, in practice, be able to withstand temperatures somewhat in excess of 750° C. For the purposes of this specification, therefore, "thermally stable" cutting elements will mean polycrystalline diamond cutting elements which can be subjected to some temperature in excess of about 1000° C. without suffering significant thermal degradation, whereas cutting elements which would begin to suffer significant thermal degradation at a temperature which is less than about 1000° C. will be referred to as "non-thermally stable".

An object of the invention is to provide a method of manufacturing cutter assemblies incorporating non-thermally stable cutting elements where the risk of thermal degradation of the cutting elements is reduced.

SUMMARY OF THE INVENTION

According to the invention there is provided a method of forming a cutter assembly for a rotary drill bit comprising locating in a mould a preform polycrystalline diamond cutting element of a kind which is non-thermally stable, as hereinbefore defined, packing powdered matrix-forming material around at least part of the cutting element within the mould, and infiltrating the material with a metal alloy in a furnace to form a body of solid infiltrated matrix in which the cutting element is at least partly embedded, the metal alloy being selected to provide an infiltration temperature which is not greater than the temperature at which significant thermal degradation of the cutting element would occur.

Preferably the infiltration temperature is not greater than 850° C., and more preferably not greater than 750° C.

Accordingly, the comparatively low temperature infiltration does not cause significant thermal degradation of the polycrystalline diamond cutting element, but produces a carrier, formed of solidified matrix material, to which the cutting element is firmly secured.

The cutting element may be a two-layer or multi-layer element including a front cutting table of polycrystalline diamond bonded to a substrate of less hard material, such as cemented tungsten carbide. As previously mentioned, the cutting element may be in the form of a tablet, for example circular or part-circular, of substantially constant thickness.

Preferably the mould is so shaped that the body of matrix material is in the form of a generally cylindrical stud, preferably of circular cross section, the cutting element having an edge portion projecting from one end of the stud and providing the cutting edge of the finished assembly.

In the case where the cutting element is in the form of a flat tablet, the cutting element may be inclined at an angle, for example 45°, to the longitudinal axis of the stud. The central axis of the cutting element may be coincident with the longitudinal axis of the stud.

Superhard particles, such as natural diamonds, may be located in the mould, adjacent the cutting element, so as to become embedded in the matrix material of the finished body of the cutter assembly. Preferably the superhard particles are embedded in a part of the body of matrix material which, in use of the cutter assembly, is disposed rearwardly of the cutting element with respect to the normal direction of forward movement of the cutter assembly.

The invention includes within its scope a cutter assembly for a rotary drill bit, when manufactured by any of the methods referred to above.

The invention also includes a drill bit of the kind first referred to wherein at least certain of the cutter assemblies mounted on the bit body are formed by any of the methods referred to above. In such a drill bit, one or more cutter assemblies according to the invention may comprise secondary backup cutter assemblies associated with and placed rearwardly of respective primary cutter assemblies on the bit body.

BRIEF DESCRIPTION OF THE DRAWINGS

FIG. 3 is a diagrammatic side elevation of a typical prior art polycrystalline diamond cutter assembly, FIG. 4 is a side elevation of one form of cutter assembly manufactured according to the present invention, FIG. 5 is a diagrammatic vertical section through a mould in the process of forming a cutter assembly according to the present invention.

DETAILED DESCRIPTION OF THE PREFERRED EMBODIMENTS

Figure 1:
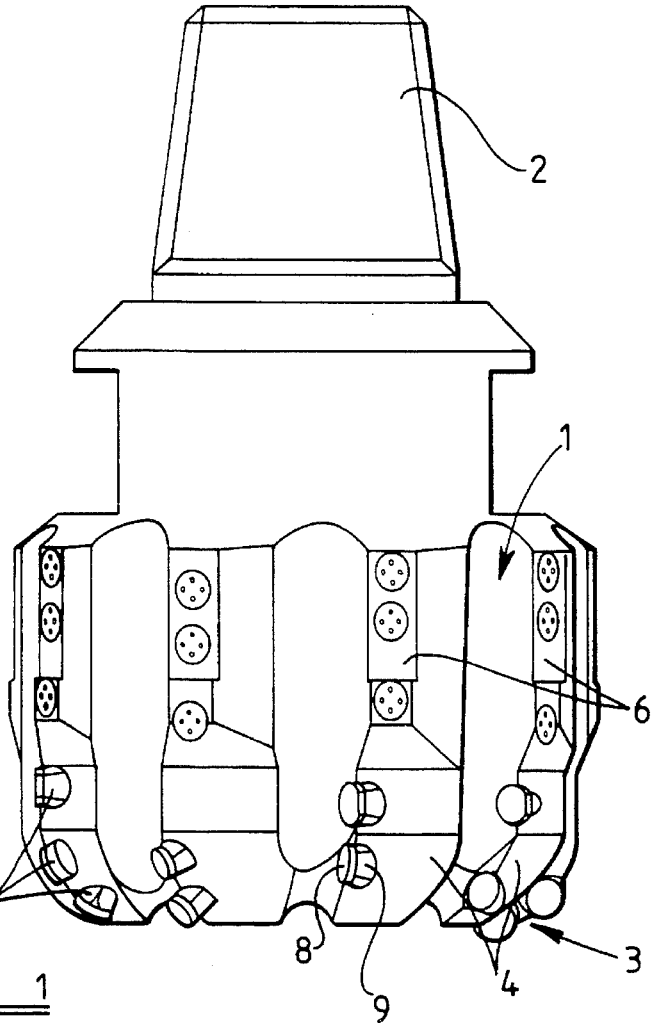
FIG. 1 is a side elevation of a typical drag bit in which cutter assemblies according to the present invention may be used.
Figure 2:
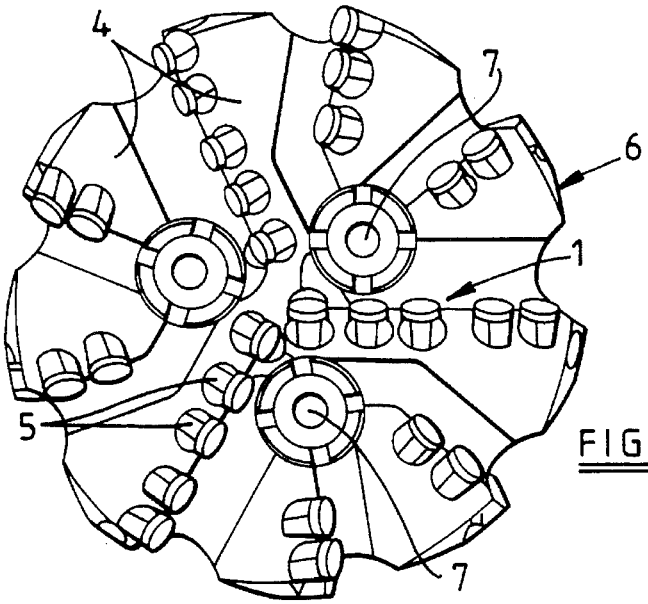
FIG. 2 is an end elevation of the drill bit shown in FIG. 1.

FIGS. 1 and 2 show a typical full bore drag bit of a kind in which cutter assemblies according to the present invention may be employed. The bit body 1 is machined from steel and has a shank formed with an externally threaded pin 2 at one end for connection to the drill string. The operative end face 3 of the bit body is formed with a number of blades 4 radiating from the central area of the bit, and the blades carry cutter assemblies 5 spaced apart along the length thereof. The bit has a gauge section including kickers 6 which contact the walls of the borehole to stabilize the bit in the borehole. A central passage (not shown) in the bit body and shank delivers drilling fluid through nozzles 7 in the end face 3 in known manner.

Each cutter assembly 5 comprises a preform cutting element 8 mounted on a carrier 9 in the form of a post which is secured within a socket in the bit body. Each preform cutting element is in the form of a circular tablet comprising a thin facing table of polycrystalline diamond bonded to a substrate of cemented tungsten carbide. The rear surface of the substrate is bonded, for example by brazing, to a suitably orientated surface on the post 9.

FIG. 3 is a side elevation showing one form of typical prior art cutter assembly in greater detail. The cutting element 8 comprises a cutting table 10 of polycrystalline diamond having a front cutting face 11, a peripheral surface 12 and a rear face 13 bonded to a substrate 14 of cemented tungsten carbide or other material which is less hard than the polycrystalline diamond. The rear surface of the substrate 14 is bonded, for example by the brazing process known as "LS bonding" to an inclined surface 15 on the carrier or post 9. The post 9 may also be formed from cemented tungsten carbide.

The cutting edge 16 of the cutting element 8 comprises the lowermost portion of the junction between the front cutting face 11 and the peripheral surface 12 of the diamond layer.

FIGS. 4 and 5 show how a cutting element of the kind used in the cutter assembly of FIG. 3 may be employed in a cutter assembly in accordance with the present invention.

Referring to FIG. 4, which is a side elevation of a cutter assembly according to the invention, the cutting element 8 is partly embedded in a cylindrical post-like body 17 of solid infiltrated matrix material. It will be seen from FIG. 4 that a thin layer of the matrix material extends across each side of the cutting element 8, as indicated at 19, to provide additional support therefore. FIG. 5 shows diagrammatically the manner in which the cutter assembly is formed. There is provided a two-part mould formed of suitable material, such as graphite, and providing a generally cylindrical mould cavity 22. A flat inclined abutment 23 is formed in the lower part of the mould to support the cutting element 8 in the required rotational and angular orientation. The mould is then packed, around the cutting element 8, with a powdered matrix-forming material, such as tungsten carbide. Space is left within the cavity 22, and above the powdered material, to receive a suitable infiltration metal alloy, usually in the form of a solid disc of such alloy. The mould is then placed in a furnace so that the metal alloy melts and infiltrates downwardly through the tungsten carbide powder to bond the particles together to form a hard matrix in which the cutting element 8 is embedded and thus secured. The process is generally similar in principle to the powder metallurgy process often employed for moulding bit bodies, as previously mentioned.

However, as previously described, conventional cutting elements of the kind shown are not normally thermally stable at temperatures above about 750° C., and any cutting element which begins to suffer significant thermal degradation at any temperature up to about 1000° C. is also regarded as being non-thermally stable. In the normal infiltration process for forming bit bodies, the infiltration alloy is usually such that an infiltration temperature in the range of 1100° C. to 1170° C. is required. As previously mentioned, such temperatures would cause serious degradation of a non-thermally stable cutting element. According to the present invention, therefore, the metal alloy selected for the infiltration process has an infiltration temperature which is not greater than the temperature which the cutting element can withstand and is preferably not greater than about 850° C. The matrix-forming process can then take place without significant thermal degradation of the cutting element.

Various suitable low temperature infiltration alloys are available. For example, one such low temperature alloy comprises 45% silver, 15% copper, 16% zinc and 24% cadmium. However, such alloy is comparatively costly as a result of its high silver content. A preferred low temperature infiltrating alloy, therefore, is of any of the kinds described in U.S. Pat. No. 4,669,522 where the alloy is a copper based alloy containing phosphorous. For example the alloy may be of substantially eutectic composition comprising approximately 8.4% phosphorous in a copper base. Alternatively, the alloy may comprise approximately 85% copper, up to 10% tin and up to 10% phosphorous. Other copper-phosphorous alloys are described which also contain silver.

Although tungsten carbide is preferred as the matrix-forming material, the invention does not exclude other materials or combinations of materials. For example, it may be advantageous to include particles of tungsten metal with the tungsten carbide.

Although cutter assemblies according to the invention may be used as primary cutters on a drill bit, they may also be used as secondary or backup cutter assemblies associated with primary cutter assemblies of known kinds, such the kind shown in FIG. 3.

Figure 6:
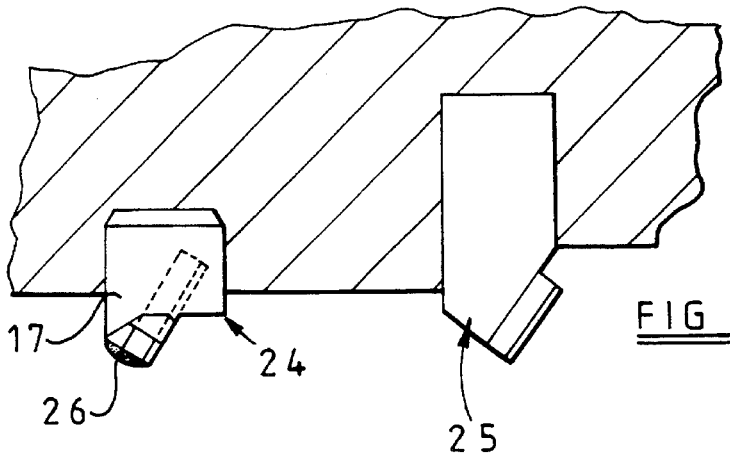
FIG. 6 is a diagrammatic section through part of a drill bit body showing a cutter assembly according to the present invention in use as a backup to a conventional cutter assembly.

FIG. 6 shows diagrammatically an arrangement in which a cutter assembly according to the present invention, indicated at 24, is located rearwardly of a conventional cutter assembly, indicated at 25. The backup assembly 24 then operates in the usual way for such backup assemblies in so called "hybrid" bits. That is to say it serves to provide a backup cutting function in the event of excessive wear or failure of the primary cutter assembly 25, and also serves to protect the primary cutter against impact damage and also to limit the depth to which the primary cutter bites into the formation.

In order to enhance the backup effectiveness of the cutter assembly 24, particles of superhard material 26, such as small natural diamonds, may be embedded in the matrix material of the stud 17 to the rear of the cutting element. For this purpose the mould cavity 22 of FIG. 5 is provided with an additional depression (indicated in dotted line at 21) rearwardly of the cutting element 8. This depression is filled with a mixture of superhard and matrix-forming particles, before the rest of the cavity 22 is filled with matrix-forming particles, so that the superhard particles become embedded in the matrix during formation of the stud 17. Such particles of superhard material may also be employed in cutter assemblies according to the invention which are used as primary cutters.

Figure 7:
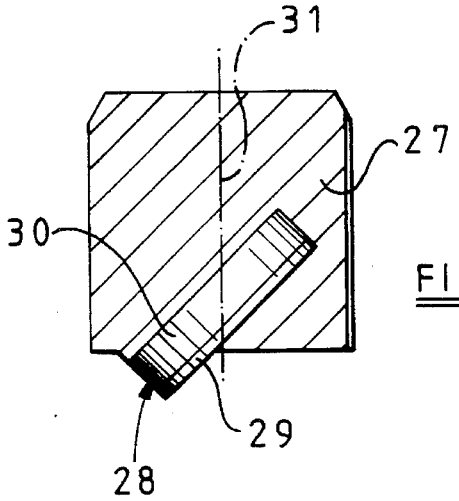
FIG. 7 is a longitudinal section through another form of cutter assembly according to the present invention, taken along the line 7—7 of FIG. 8
Figure 8:
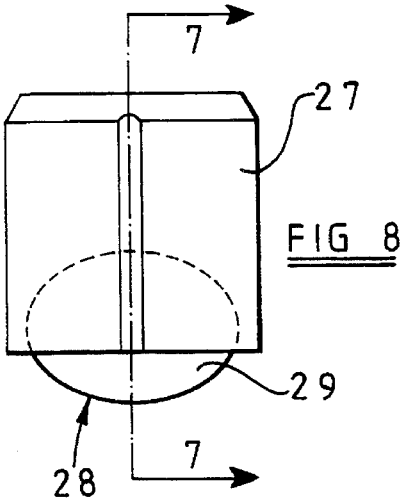
FIG. 8 is a front elevation of the cutter assembly of FIG. 7.
Figure 9:
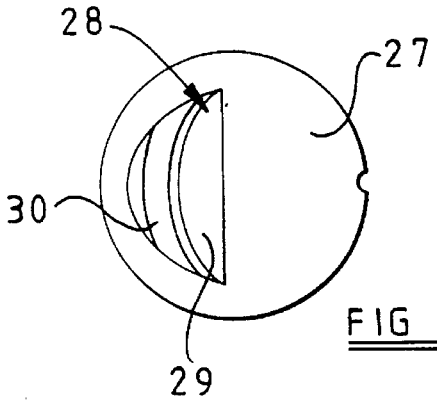
FIG. 9 is an end elevation of the cutter assembly of FIGS. 7 and 8.

FIGS. 7 to 9 show an alternative form of cutter assembly manufactured according to the present invention. In this case the carrier which is moulded from matrix material, by a process similar to that described in relation to FIGS. 4 and 5, is in the form of a cylindrical stud 27 of circular cross-section. The cutting element 28 comprises a front cutting table 29 of polycrystalline diamond bonded to a substrate 30, for example of cemented tungsten carbide. In the arrangement shown the centre of the cutting element 28 lies on the central axis 31 of the stud and the cutting element is inclined at 45° to that axis.

In the above described arrangements the stud or post in which the cutting element is embedded is received within a socket in the bit body and is secured in the socket, for example by brazing or by shrink fitting.

I claim:

1. A cutter assembly for a rotary drill bit comprising a preformed polycrystalline diamond cutting element at least partly embedded in a solid post, the cutting element comprising a layer of polycrystalline diamond bonded to a substrate of a material less hard than the polycrystalline diamond and being a non-thermally stable cutting element of a kind which begins to suffer significant thermal degradation at a temperature which is less than about 1000° C., and said solid post being formed from solid infiltrated matrix material comprising a body of particles of a powdered material which is less hard than the polycrystalline diamond, the particles having been bonded together by infiltration into the body of particles of a molten metal alloy which has subsequently solidified.

2. A cutter assembly according to claim 1 wherein the cutting element is in the form of an at least partly circular tablet of substantially constant thickness.

3. A cutter assembly according to claim 1 wherein the cutting element has an edge portion projecting from one end of the solid post and providing a cutting edge of the finished assembly.

4. A cutter assembly according to claim 1 wherein the solid post is of circular cross section.

5. A cutter assembly according to claim 1 wherein the solid post has a longitudinal axis and wherein the cutting element is in the form of a flat tablet inclined at an angle to the longitudinal axis of the solid post.

6. A cutter assembly according to claim 5 wherein the cutting element is inclined at an angle of about 45° to the longitudinal access of the solid post.

7. A cutter assembly according to claim 5 wherein the center of the cutting element lies on the central longitudinal axis of the solid post.

8. A cutter assembly according to claim 1 wherein superhard particles are embedded in the solid infiltrated matrix material adjacent the cutting element.

9. A cutter assembly according to claim 8 wherein said superhard particles are natural diamond particles.

10. A drill bit comprising a bit body having a shank for connection to a drill string, a plurality of cutter assemblies mounted at the surface of the bit body, and a passage in the bit body for supplying drilling fluid to the surface of the bit body for cooling and cleaning the cutter assemblies, wherein at least certain of the cutter assemblies mounted on the bit body each comprise a preformed polycrystalline diamond cutting element at least partly embedded in a solid post, the cutting element comprising a layer of polycrystalline diamond bonded to a substrate of a material less hard than the polycrystalline diamond and being a non-thermally stable cutting element of a kind which begins to suffer significant thermal degradation at a temperature which is less than about 1000° C., and said solid post being formed from solid infiltrated matrix material comprising a body of particles of a powdered material which is less hard than the polycrystalline diamond, the particles having been bonded together by infiltration into the body of particles of a molten metal alloy which has subsequently solidified.

11. A drill bit according to claim 10 further comprising at least one secondary backup cutter assembly associated with and placed rearwardly era respective primary cutter assembly on the bit body.

* * * * *